US006669509B2

(12) United States Patent
Ichida et al.

(10) Patent No.: US 6,669,509 B2
(45) Date of Patent: Dec. 30, 2003

(54) WATERTIGHT CONNECTOR

(75) Inventors: Kiyofumi Ichida, Yokkaichi (JP); Yasushi Okayasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/201,140

(22) Filed: Jul. 22, 2002

(65) Prior Publication Data

US 2003/0015871 A1 Jan. 23, 2003

(30) Foreign Application Priority Data

Jul. 23, 2001 (JP) ..... 2001-221858

(51) Int. Cl.[7] ..... H01R 13/40
(52) U.S. Cl. ..... 439/595; 439/271; 439/157
(58) Field of Search ..... 439/595, 157, 439/271

(56) References Cited

U.S. PATENT DOCUMENTS 4,806,123 A * 2/1989 Konishi et al. ..... 439/595
4,998,896 A * 3/1991 Lundergan ..... 439/595
5,730,625 A * 3/1998 Sikora ..... 439/595
5,820,409 A * 10/1998 Clark et al. ..... 439/595
5,839,925 A * 11/1998 Simmons ..... 439/852
6,045,404 A * 4/2000 Myer ..... 439/595
6,116,953 A * 9/2000 Myer ..... 439/595
6,159,047 A * 12/2000 Tanaka ..... 439/595
6,361,341 B1 * 3/2002 Okayasu et al. ..... 439/271

* cited by examiner

*Primary Examiner*—Tho D. Ta
*Assistant Examiner*—Larisa Tsukerman
(74) *Attorney, Agent, or Firm*—Anthony J. Casella; Gerald E. Hespos

(57) ABSTRACT

Channels (20) are formed in a partition wall (19) between a sealing surface (14) on the outer peripheral surface of a housing (10) and ceiling surfaces **(16*a*) of cavities (12*a*) having a back-to-back relationship with the sealing surface (14) by cutting the ceiling surfaces (16*a*) of the cavities (12*a*). Thus, even if the partition wall (19) is thick, a "sink mark" is difficult to form when the housing (10) is molded by a mold and, therefore, a deformation of the sealing surface (14)** resulting the "sink mark" can be prevented.

12 Claims, 7 Drawing Sheets

WATERTIGHT CONNECTOR

BACKGROUND OF THE INVENTION

1. Field of the Invention

The present invention relates to a watertight connector.

2. Description of the Related Art

A known watertight connector has a ring-shaped seal mounted on the outer peripheral surface of a female housing. The female housing can be fit into a receptacle of a male connector so that a clearance between the inner peripheral surface of the receptacle and the outer peripheral surface of the female housing is held watertight by the seal.

A good watertight performance in a connector of this type requires the sealing surfaces of both housings to be smooth and a degree of resilient deformation of the sealing member needs to be uniform over the entire circumference. However, the sealing surface on the outer peripheral surface of the female housing may not necessarily be smooth depending on the inner construction of the female housing. For example, resiliently deflectable locks may be formed along the inner wall surfaces of the cavities in the female housing for locking the female terminal fittings in the cavities. The sealing surface may be defined in an area having a back-to-back relationship with the locks and may be located behind the locks. The thickness between the inner surface of the cavity and the corresponding outer peripheral surface of the housing is the sum of the thickness of the lock, the thickness of the deformation permitting space for the lock and the thickness of the wall on the side of the deformation permitting space opposite the lock. Thus, portions of the wall of the housing near the deformation permitting space and the lock are likely to be very thick, and these thick portions of the walls are likely to include the sealing surface on the outer periphery of the female housing.

A deformation called a "sink mark" often occurs during the resin molding of a thick part. Thus, a "sink mark" is likely to be formed at part of the sealing surface along the thick area of the wall, and that part of the sealing surface may not be smooth., The present invention was developed in view of the above problem and an object thereof is to prevent a deformation of a sealing surface resulting from formation of a "sink mark" during resin molding.

SUMMARY OF THE INVENTION

The invention is directed to a watertight connector constructed such that a clearance between a sealing surface on the outer peripheral surface of a housing made of a synthetic resin and the inner peripheral surface of a mating connector can be sealed by a sealing member. The connector has at least one cavity formed in the housing for receiving at least one terminal fitting. At least one lock is arranged along an inner wall surface of the cavity for preventing the corresponding terminal fitting from coming out. The lock is arranged along an inner wall surface of the cavity that has a back-to-back relationship with the sealing surface and preferably is spaced from or before the sealing surface along the longitudinal direction of the watertight connector. At least one cut-away portion or channel is formed in a wall portion between the sealing surface and the inner wall surfaces of the cavity that has a back-to-back relationship with the sealing surface by cutting the inner wall surface of the cavity. Thus, even if the wall is thick, a "sink mark" is not likely to be formed when the connector housing is molded by the mold and a deformation of the sealing surface resulting from the "sink mark" can be prevented.

Preferably, the channels are formed along the widthwise left and right edges of the inner wall surfaces of the cavities having a back-to-back relationship with the sealing surface.

Mold-removal slits preferably are formed at the opposite sides of the locks by removing a mold when the connector housing is molded. The channels and the mold-removal slits preferably communicate with each other. The channels are wider than the mold-removal slits. Thus, the mold for forming the channels can be wider and stronger.

A mating connector preferably can be pulled into the connector housing and connected therewith by a cam action of a cam mechanism when a lever on the watertight connector is rotated.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

The letter F in FIGS. 1 to 8 identifies a watertight lever-type connector according to the invention. The connector F has a synthetic resin housing 10 into which female terminal fittings 23 are insertable. The illustrated connector F also has a lever 24 made e.g. of a synthetic resin. A mating connector M to be connected with the watertight connector F accommodates male terminal fittings (not shown) inside and includes a substantially rectangular forwardly projecting receptacle Mf. Cam pins Mp project from the left and right side surfaces of the receptacle Mf. The lever 24 can be rotated with the cam pins Mp engaged in cam grooves 25 formed in the lever 24. Thus, the two connectors F, M are connected with each other.

Figure 1:
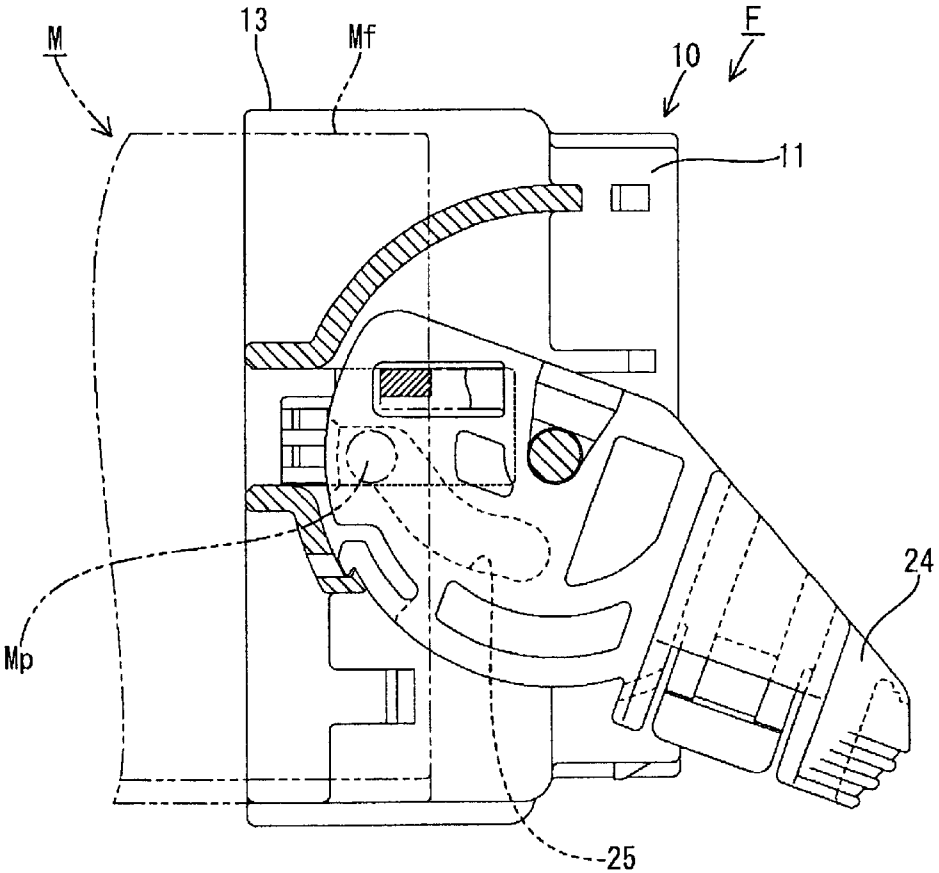
FIG. 1 is a plan view partly in section showing a state of an initial stage of connection with a mating connector in accordance with the invention.
Figure 2:
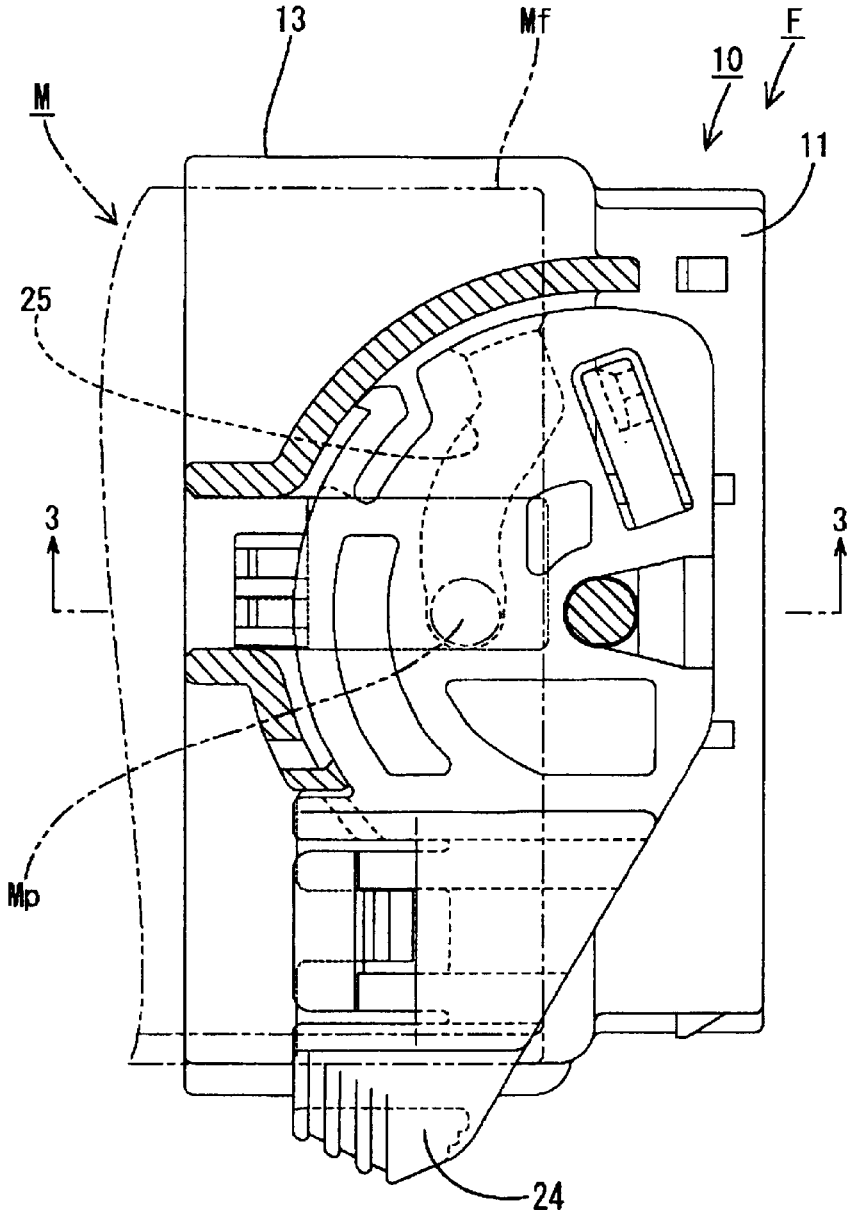
FIG. 2 is a plan view partly in section showing a connected state with the mating connector.
Figure 3:
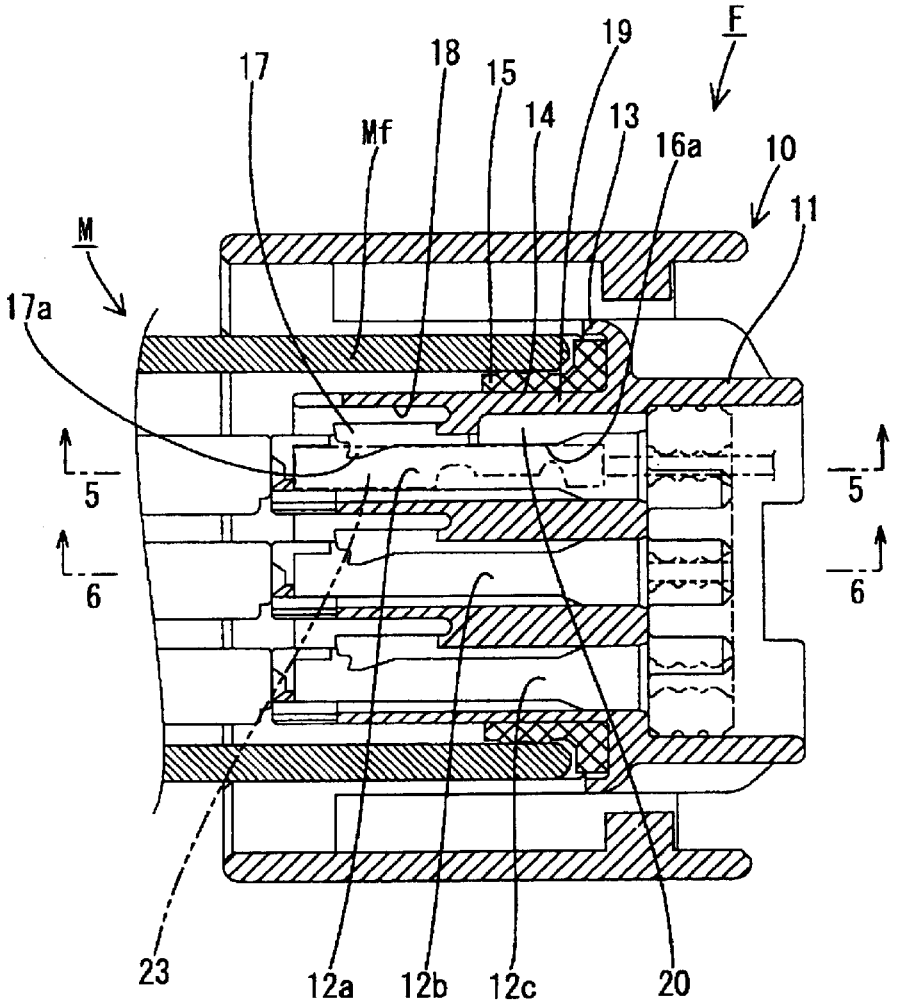
FIG. 3 is a section along 3—3 of FIG. 2.
Figure 4:
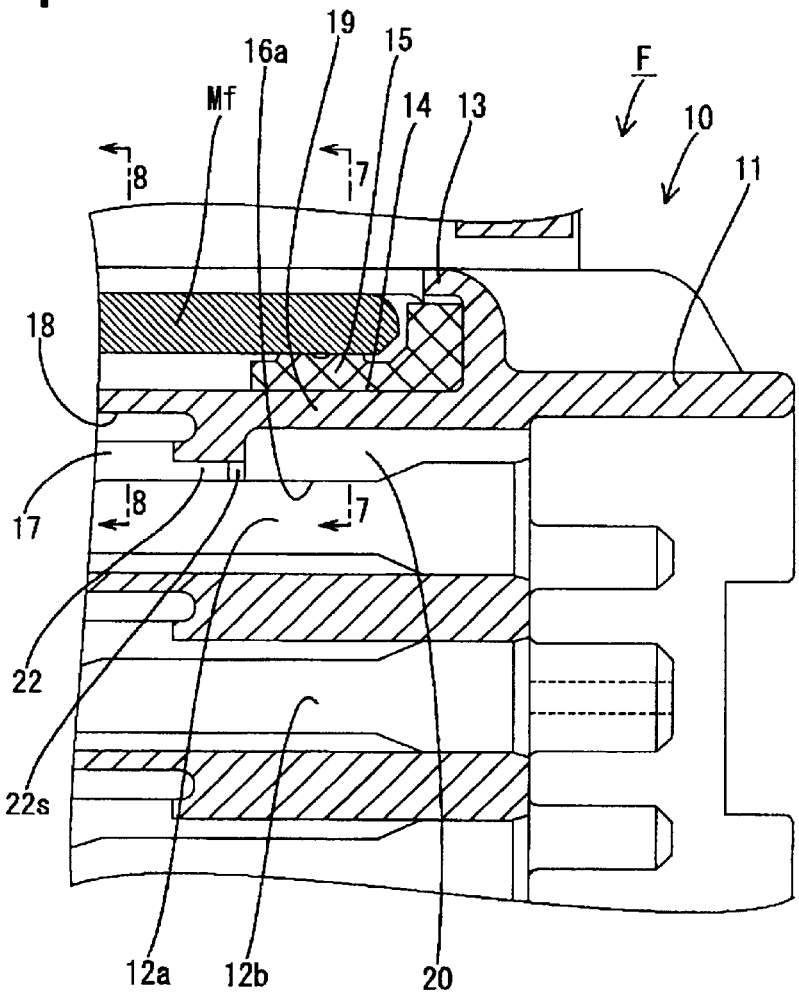
FIG. 4 is a partial enlarged view of FIG. 3.
Figure 5:
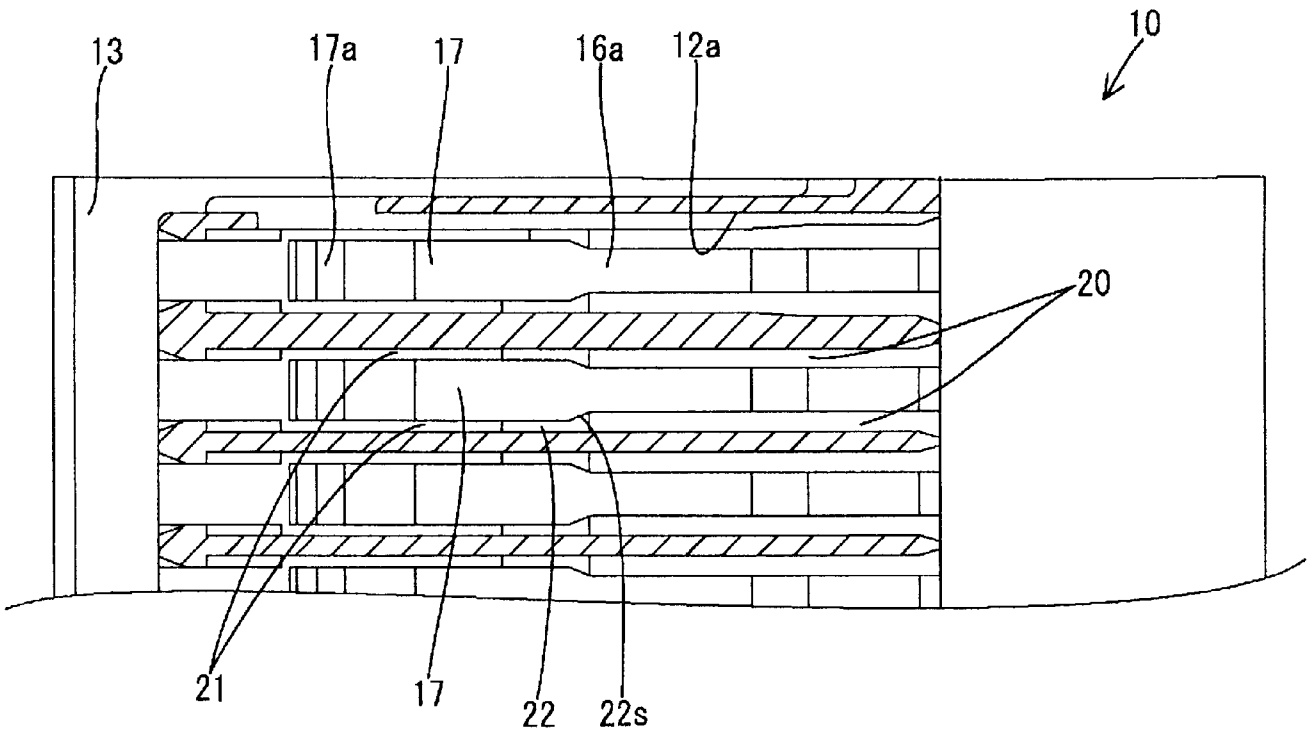
FIG. 5 is a section along 5—5 of FIG. 3.
Figure 6:
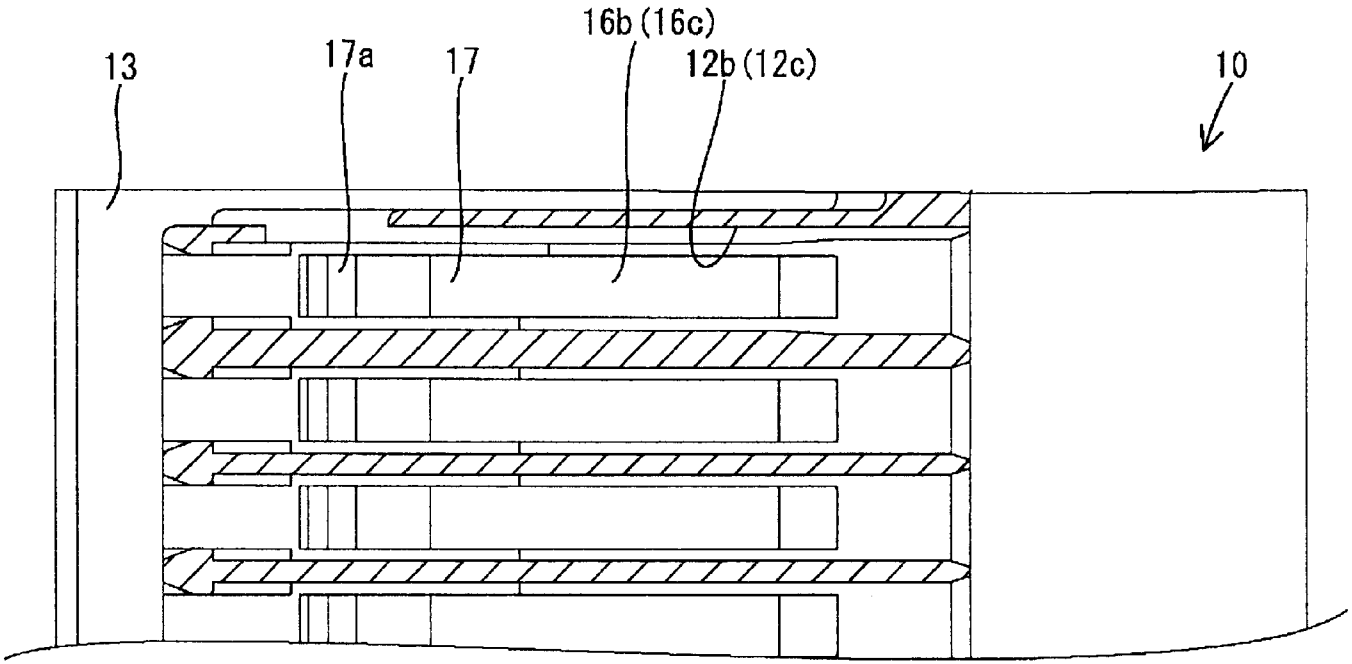
FIG. 6 is a section along 6—6 of FIG. 3.
Figure 7:
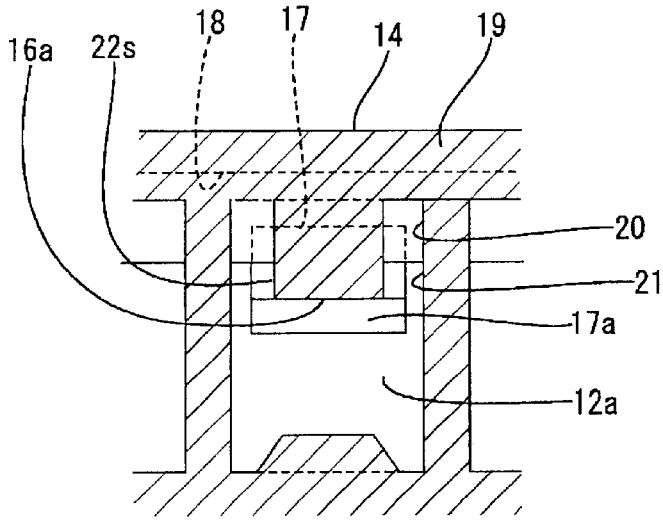
FIG. 7 is a section along 7—7 of FIG. 4.
Figure 8:
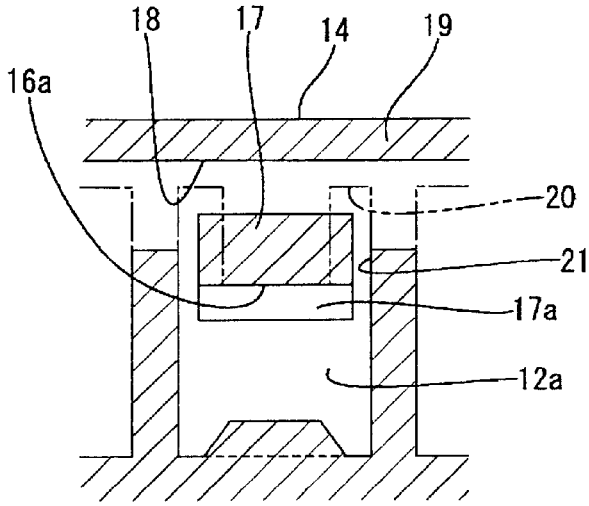
FIG. 8 is a section along 8—8 of FIG. 4.

In the following description, a mating side of the watertight connector F (left side in FIGS. 1 to 6) is referred to as the front side and reference is made to FIGS. 3 and 4 concerning the vertical direction.

The housing 10 has a substantially block-shaped main body 11 formed with cavities 12*a*, 12*b*, 12*c* into which the female terminal fittings 23 are insertable from behind, and a substantially rectangular tubular fitting 13 substantially surrounds the main body 11. The rectangular receptacle Mf of the mating connector M is fittable into a space defined between the tubular fitting 13 and the main body 11. An area of the outer peripheral surface of the connector housing 10 near the rear end of the tubular fitting 13 is a sealing surface 14. A ring-shaped seal 15 is mounted beforehand on the sealing surface 14. The seal 15 seals a space between the inner peripheral surface of the receptacle Mf and the sealing surface 14 watertight when the receptacle Mf of the mating connector M is fitted in the tubular fitting 13.

The cavities 12*a*, 12*b*, 12*c* are arrayed transversely at specified intervals in each of three stages, and are substantially rectangular when viewed from front. Locks 17 are cantilevered forward at substantially front halves of ceiling surfaces 16*a*, 16*b*, 16*c* of the respective cavities 12*a*, 12*b*, 12*c*. The locks 17 are configured to prevent the female terminal fittings 23 inserted into the cavities 12*a*, 12*b*, 12*c* from coming out backwardly. A projection 17*a* at the front end of each lock 17 interferes with the upper surface of the corresponding female terminal fitting 23 during the insertion of the female terminal fitting 23 into the cavity 12*a*, 12*b*, 12*c*. Thus, the lock 17 is deformed resiliently into a deformation permitting space 18 and is retracted from an insertion path for the female terminal fitting 23. When the female terminal fitting 23 reaches a proper insertion position, the lock 17 returns resiliently to engage the projection 17*a* with a locking hole (not shown) of the female terminal fitting 23. As a result, the female terminal fitting 23 is locked and will not come out.

The ceiling surfaces 16*a* of the cavities 12*a* at the uppermost stage have a back-to-back relationship with the sealing surface 14, and a partition wall 19 is provided therebetween. The locks 17 that extend along the ceiling surfaces 16*a* of the cavities 12*a* have a back-to-back relationship with the sealing surface 14. The rear ends of the locks 17 are more forward than or more towards a mating side than the front end of the sealing surface 14. Accordingly, the rear ends of the locks 17 also are before the front end of the seal 15 mounted on the sealing surface 14. In other words, the points of support of the locks 17 are spaced from the closest end of the sealing surface 14 along the longitudinal direction of the watertight connector F toward its mating side with the mating connector M.

The partition wall 19 between the ceiling surfaces 16*a* of the cavities 12*a* at the uppermost stage and the sealing surface 14 is considerably thick in view of the required thickness of the locks 17 and the thickness of the deformation permitting spaces 18 for the locks 17. Thus, a "sink mark" may be formed in the partition wall 19 when the housing is molded and, as a result, the sealing surface 14 may not be smooth.

As a countermeasure, grooves in the ceiling wall 16*a* of each cavity 12*a* form left and right cut-away channels 20 in the partition wall 19. The channels 20 extend in forward and backward directions along the widthwise left and right edges of the ceiling walls 16*a* (see FIG. 5). Each channel 20 has a depth from the ceiling surfaces 16*a* that exceeds its width (see FIG. 7). The outer side surfaces of the channel 20 are substantially flush with the side surfaces of the cavities 12*a*. Left and right mold-removal slits 21 are formed at the left and right sides of each lock 17 by removing the mold when the connector housing 10 is molded. The front ends of the channels 20 communicate with the rear ends of the mold-removal slits 21, and the channels 20 are wider than the mold-removal slits 21. Communication grooves 22 provide communication between the channels 20 and the mold-removal slits 21, and have a depth from the ceiling surfaces 16*a* that is less than the channels 20. The outer side surfaces of the communication grooves 22 are substantially flush with both the outer side surfaces of the mold-removal slits 21 and those of the channels 20. The inner side surfaces of the communication grooves 22 are slanted surfaces 22*s* oblique to both the inner side surfaces of the mold-removal slits 21 and those of the channels 20.

As described above, the channels 20 are formed in the partition wall 19 between the sealing surface 14 and the ceiling surfaces 16*a* of the cavities 12*a* at the uppermost stage having a back-to-back relationship with the sealing surface 14 by cutting the ceiling surfaces 16*a*. Thus, even if the partition wall 19 is thick, the "sink mark" is not likely to be formed when the housing 10 is molded. Therefore, deformation of the sealing surface 14 resulting from the "sink mark" can be prevented, thereby allowing the sealing surface 14 to be smooth. As a result, a high sealing function can be displayed.

The mold for forming the channels 20 and the mold-removal slits 21 has a mold section (not shown) that is narrow and long in forward and backward directions. This mold section is removed backward after molding. The channels 20 are wider than the mold-removal slits 21. Therefore, the mold portion for forming the channels 20 is wider than a mold section for forming the side surfaces of the locks, thereby being strengthened.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the channels are formed along the opposite side edges of the inner wall surfaces of the cavities in the foregoing embodiment, they may be formed at the widthwise center positions of the inner wall surfaces of the cavities according to the present invention.

Although the channels are wider than the mold-removal slits at the opposite sides of the locks in the foregoing embodiment, they may have the same width as the mold-removal slits at the opposite sides of the locks according to the present invention.

Although the channels and the mold-removal slits communicate with each other in the foregoing embodiment, they may not communicate according to the present invention.

Although the invention is applied to the female connector housing with female terminal fittings in the foregoing embodiment, it may be applied to a male connector housing with male terminal fittings.

Although the invention is applied to a lever-type connector in the foregoing embodiment, it may be applied to connectors other than lever-type connectors.

What is claimed is:

1. A watertight connector (F) having a housing (10) formed from a synthetic resin, a sealing surface (14) being defined on an outer peripheral surface of the housing (10) for receiving a seal (15), comprising:

at least one cavity (12) formed in the housing (10) for receiving at least one corresponding terminal fitting (23);

at least one lock (17) arranged along an inner wall surface (16) of the cavity (12) for preventing the corresponding terminal fitting (23) from coming out, the lock (17) having a back-to-back relationship with the sealing surface (14) and being spaced from the sealing surface (14), wherein at least one channel (20) is formed in a wall (19) between the sealing surface (14) and the inner wall surface (16) of the cavity (12) having a back-to-back relationship with the sealing surface (14) by cutting the inner wall surface (16) of the cavity (12).

2. The watertight connector of claim 1, wherein the channel (20) is formed along a widthwise lateral edge of the inner wall surface (16) of the cavity (12) having a back-to-back relationship with the sealing surface (14).

3. The watertight connector of claim 2, wherein mold-removal slits (21) are formed at the opposite sides of the locking portion (23) by removing a mold when the connector housing (10) is molded by the mold.

4. The watertight connector of claim 3, wherein the channel (20) and the mold-removal slits (21) communicate with each other.

5. The watertight connector of claim 4, wherein the channel (20) is wider than the mold-removal slits (21).

6. The watertight connector of claim 1, wherein a mating connector (M) can be pulled into the housing (10) and connected therewith by a cam action of a cam mechanism (Mp, 25) when a lever (24) on the watertight connector is rotated.

7. A watertight connector (F) having a housing (10) formed from a synthetic resin, the housing (10) having opposite front and rear ends, at least one outer wall (19) extending between the front and rear ends, said outer wall (19) defining an outer peripheral surface of the housing (10), a portion of the outer peripheral surface between the front and rear ends defining a sealing surface (14), at least one cavity (12) extending through the housing (10) from the rear end to the front end thereof, the cavity (12) being formed partly by the outer wall (19), a resiliently deflectable lock (17) being formed in the cavity (12) and being cantilevered forwardly from a location on the outer wall (19) forwardly of the sealing surface (14), at least one channel (20) being formed in a surface of said outer wall (19) facing into the cavity (12) and extending from the lock (17) rearwardly to a location rearward of the sealing surface (14), such that said channel (20) is in substantially back-to-back relationship with said sealing surface (14).

8. The watertight connector of claim 7, wherein the cavity (12) has opposed sidewalls extending substantially orthogonally from the outer wall (19) and spaced from said lock (17) by a: selected distance, said channel (20) being wider than the distance between the sidewalls of the cavity (12) and the lock (17).

9. The watertight connector of claim 8, wherein said cavity (12) has two of said channels (20) disposed respectively adjacent the sidewalls of the cavity (12).

10. The watertight connector of claim 9, wherein the mold-removal slits (21) communicate with the channels (20).

11. The watertight connector of claim 10, wherein the cavity (12) includes a ceiling **(16*a*) rearwardly of and substantially aligned with the lock (17), the channels (20) being on opposite respective sides of the ceiling (16*a*)**.

12. The watertight connector of claim 10, wherein each of the channels (20) has a depth measured perpendicular to the outer wall (19) that exceeds the width of the channel (20) measured parallel to the outer wall (19).

* * * * *